United States Patent [19]

Itoh et al.

[11] 4,123,851

[45] Nov. 7, 1978

[54] CLOTHES DRIER

[75] Inventors: Kinya Itoh; Shigeaki Tanaka, both of Hitachi; Gen Shimizu, Mito; Yuzi Suganuma, Hitachi, all of Japan

[73] Assignee: Hitachi, Ltd., Japan

[21] Appl. No.: 815,434

[22] Filed: Jul. 13, 1977

Related U.S. Application Data

[63] Continuation of Ser. No. 653,102, Jan. 28, 1976, abandoned.

[30] Foreign Application Priority Data

Jul. 18, 1975 [JP] Japan ..... 50-88018
Jul. 18, 1975 [JP] Japan ..... 50-88019

[51] Int. Cl.[2] ..... F26B 11/04

[52] U.S. Cl. ..... 34/48; 34/82; 34/133; 219/504

[58] Field of Search ..... 98/41 SV, 40 C; 34/133, 34/54, 48, 51, 82; 219/504, 505

[56] References Cited

U.S. PATENT DOCUMENTS

| | | | |
|---|---|---|---|
| 2,525,371 | 10/1950 | Reynold, Sr. | 98/41 SV |
| 2,569,515 | 10/1951 | Collins | 34/54 |
| 2,942,353 | 6/1960 | Barnett | 34/133 |
| 3,475,831 | 11/1969 | Workman | 34/133 |
| 3,927,300 | 12/1975 | Wada et al. | 219/381 |

*Primary Examiner*—John J. Camby
*Assistant Examiner*—Larry I. Schwartz
*Attorney, Agent, or Firm*—Craig & Antonelli

[57] ABSTRACT

A clothes drier, in which a drum having an opening for charging clothes therethrough, an air intake port and an air exhaust port is rotatably supported in a cabinet. The air heated by a thermistor having a positive temperature coefficient is fed into the drum. This heat generating body tends to lower the heating value as the temperature rises, thus dispensing with a protective or safety means such as a thermostat.

8 Claims, 5 Drawing Figures

CLOTHES DRIER

This is a continuation of application Ser. No. 653,102 filed Jan. 28, 1976 now abandoned.

This invention relates to improvements in a clothes drier, and more particularly to a clothes drier adapted for domestic use, which utilizes a thermistor having a positive temperature coefficient. (This will be referred to as a PTC thermistor, hereinafter.)

A clothes drier is known, in which clothes are charged into a drum which is rotatably supported in a cabinet, while the heated air is introduced in the drum for drying clothes. In this case, air, gas and the like are used as energy to heat air, although electric energy is considered to be most preferable from viewpoints of ease in control, safety in the event of troubles, and a maintenance cost. It is customary to use a ferro- chrome wire as a heating element.

In general, assume that the flow rate of air travelling through the clothes drier is Q ($m^3$/min) and electric power to be consumed is P (KW), then a temperature rise $\Delta T$ (°C) of exhaust air, when the degree of drying clothes reaches about 100%, will be given as follows:

$$\Delta T = 4.63 \times 10^{-2} \times (P/Q),$$

wherein the temperature rise of exhaust air $\Delta T$ denotes the difference between the exhaust air temperature and the atmospheric temperature, when the degree of drying of clothes reaches about 100%.

Since the resistance of a ferro- chrome wire is constant, irrespective of the change in temperature, electric power consumption is constant. As a result, the temperature of a heat generating body varies, following a rightangled hyperbolic pattern, depending on the variation in the flow rate Q of air. Accordingly, the exhaust air temperature in the drum varies in inverse proportion to the flow rate of air, while the exhaust air temperature rise $\Delta T$ varies following a rightangled hyperbolic pattern. In other words, in case a ferro-chrome wire is used, lowering in the flow rate of air leads to a sharp increase in temperature of a heat generating body, thus presenting a risk of clothes being subjected to overheating as well as overheating of the heat generating body itself.

Accordingly, in case there is a risk of a filter being clogged or a blower causing a trouble as in the case of the clothes drier, it is a common practice to use a thermostat for a heat generating body as an overheating-preventive device. In addition, for protecting clothes from exposure to heat at a high temperature, a thermostat should be provided in an exhaust cylinder for detecting and adjusting an exhaust air temperature in a drum.

It is an object of the present invention to provide a clothes drier which may automatically adjust electric power consumption so as to maintain the temperature of a heat generating body below a given temperature, by utilizing a heat generating body having a self-heat-generation-adjusting function for itself.

It is another object of the present invention to provide a clothes drier which may suppress a temperature rise of a heat generating body, without using various type protective means.

According to the present invention, there is provided a clothes drier, in which a drum having an opening for charging clothes therethrough, an air intake port and an air exhaust port is rotatably supported in a cabinet, while air heated by a thermistor having a positive temperature coefficient (PTC) is fed into a drum by means of an electric blower.

Figure 1:
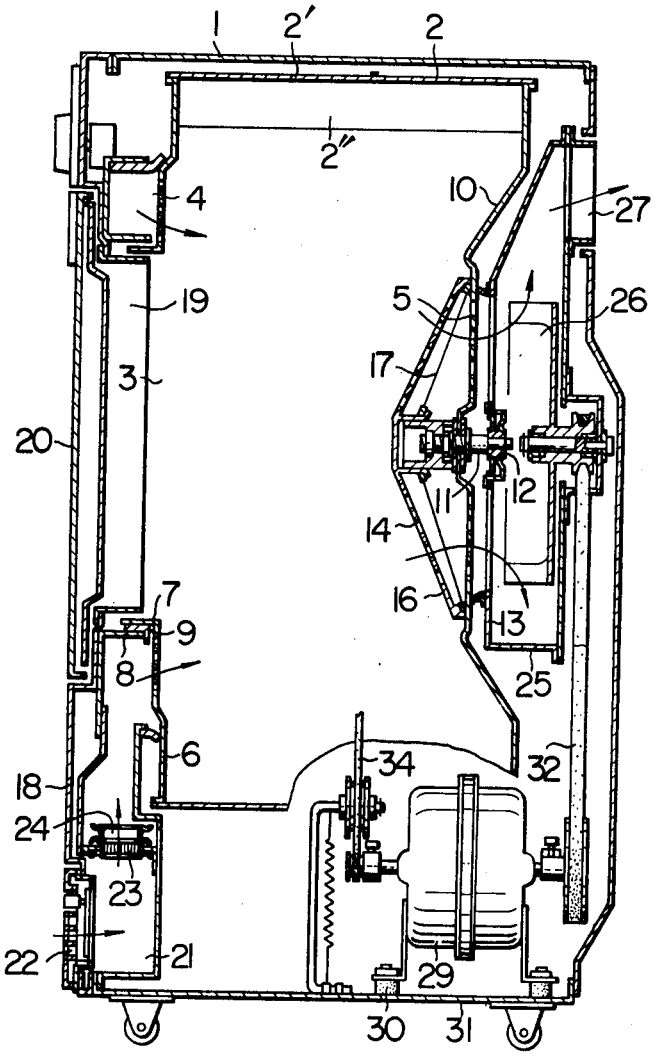
FIG. 1 is a longitudinal cross-sectional view showing one embodiment of the invention.

FIG. 1 shows a longitudinal cross-sectional view illustrative of the construction of the clothes drier according to the present invention. A drum 2 is rotatably supported within an outer frame 1. The drum 2 is provided with an opening 3 adapted to place clothes into and to take same out of the drum 2 therethrough, an air intake port 4, and an air exhaust port 5. The air intake port 4 and the air exhaust port 5 are provided in the form of perforations provided in the front and rear walls of the drum. Provided on the front wall 6 of the drum 2 is a cylindrical portion 7 which surrounds the opening 3 therewith, while the cylindrical portion 7 is rotatably supported by means of a stationary supporting member 8 and a bearing 9. A shaft 11 is secured to a rear wall 10 of the drum in its center, while the drum 2 is rotatably supported within the outer frame 1 by means of a self-aligning bearing 12 as described in detail in FIG. 3.

Several projecting plates 2'' are secured to the inner surface of the outer peripheral wall 2' of the drum 2, thus serving as lifters for clothes. (In the drawing, only one projecting place 2'' is shown.) A lint filter 14 positioned rearwardly of the rear wall 10 of the drum 2 consists of a protective filter 16 having a plurality of perforations, and a mesh-like filter 17. An opening 19 adapted to place clothes into and to take same out of the drum 2 therethrough is also provided in a front wall 18 of the outer frame 1 in concentric relation to the opening 3 provided in the drum 2. In addition, a door 20 is provided for the opening 19 for opening and closing same.

An entrance or opening 22 of an air supply duct 21 provided in the front lower portion of the outer frame 1 therein is open to atmosphere, while a heat generating body 24 using a PTC thermistor is positioned midway within the duct 21. On the other hand, a fan casing 25 and a fan 26 of an electric blower are positioned in opposing relation to the rear wall 10 of the drum 2. Accordingly, air which has been introduced through the air supply port 22 is heated by means of the heat generating body 24, and then fed through the air intake port 4 into the drum 2 so as to contact or dry clothes, then through filter 14, air exhaust port 5, and fan 26, then from the air exhaust port 27 outside the outer frame 1. An electric motor 29 is mounted by the medium of a shock-absorbing rubber or rubber cushion 30 on a bottom wall 31 of the outer frame 1, for rotating the fan 26 in the electric blower by the medium of a belt 32, as well as for rotating the drum 2 by the medium of a drive belt 34 trained around the outer periphery of the drum 2.

Figure 2:
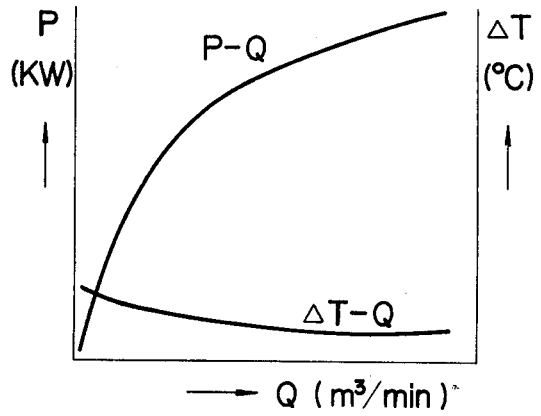
FIG. 2 is a temperature characteristic of a heat generating body for use in the present invention.

In the aforesaid arrangement of the clothes drier, the heat generating body 24 is provided as PTC thermistors, so that the heating value is automatically adjusted. More particularly, the electric power consumption (KW) increases with an increase in the flow rate Q ($m^3$/min) of air, while the electric power consumption (KW) descreases with a decrease in the flow rate Q of air. FIG. 2 shows the aforesaid relationship by a P-Q curve. As can be seen from this figure, the exhaust air temperature rise ΔT (°C), when the degree of drying of clothes reaches almost 100%, is maintained constant, irrespective of the variation in the flow rate of air. A ΔT-Q curve in FIG. 2 represents the above relationship. In other words, in case Q=0, the surface temperature of the heat generating body 24 reaches about a Curie temperature, so that the resistance is increased, resulting in a little current flowing through the heat generating body 24. As is apparent from the foregoing, the heat generating body 24 is not heated far from the Curie temperature, so that there there is no danger of the dust clothes catching fire, even such dust clothes are produced, which are clinging to the heat generating body 24.

For instance, in case there is used a heat generating body having a Curie temperature Tc of 175° C, then there is no danger of dust clothes catching fire. Meanwhile, the temperature of the heat generating body may be maintained at a low level, irrespective of the variation in the flow rate Q of air, thereby dispensing with a thermostat which is adapted to prevent overheating of the heat-generating body and clothes being dried, as in the case of the conventional type clothes drier.

Figure 3:
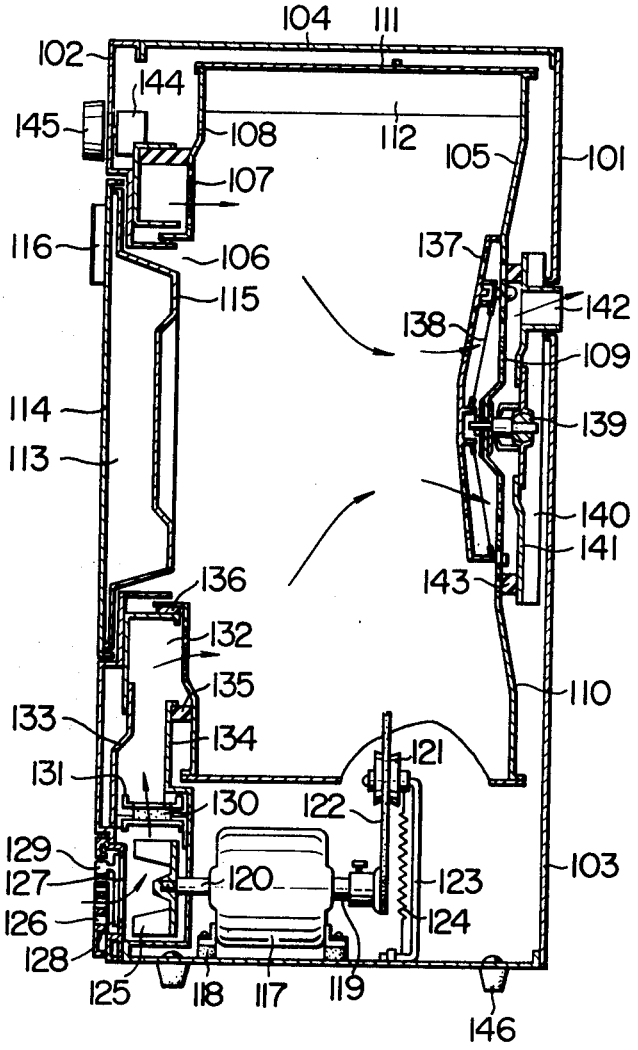
FIG. 3 is a longitudinal cross-sectional view of another embodiment of the invention.

FIG. 3 shows a longitudinal cross-sectional view of another embodiment of the present invention. Shown at 101 is a cabinet which consists of a front panel 102 having an opening therein, a rear panel 103, and an enclosure member 104 confined between the front panel 102 and the rear panel 103.

The construction of the cabinet 101 is of a reactangular parallelepiped shape, presenting desired rigidity.

Rotatably mounted within the cabinet 101 is a rotary drum 105 which is a container for clothes, and in which clothes to be dried are placed. The rotary drum 105 consists of a front wall portion 108 having an opening 106 and perforations 107 surrounding the opening 106, a rear wall portion 110 having perforations 109 in circle and a cylindrical, peripheral wall portion 111 interconnecting the front wall portion 108 and the rear wall portion 110. Thus, the rotary drum 105 is formed into a cylindrical shape. Three lifters 112 are secured to the inner surface of the cylindrical peripheral wall of the rotary drum 105 as well as to the inner surfaces of the front wall portion 108 and rear wall portion 110. A door 113 is provided on the front panel 102 of the cabinet 101 for closing the opening therein, which is adapted to place clothes into or to take same out of the cabinet 101. A front face 114 of the door 113 is substantially flush with the surface of the front panel 102. The rear face portion 108 of the door 113 projects into an opening 106 in the front wall portion 108 of the rotary drum 105.

Provided in the upper portion of the front face portion 114 of the door 113 is a handle 116. In this respect, the door 113 is opened by pulling the handle 116, thereby placing or taking clothes to be dried into or from the rotary drum 105. Mounted in the lower portion of the cabinet internally is a motor 117, which is rigidly secured on the bottom surface of the enclosure member 104 of the cabinet 101 by using a vibration-preventive rubber mount 118. The motor 117 transmits its power through two shafts 119, 120 extending on the opposite sides thereof, respectively, to a body to be driven thereby. A belt 122 is trained around the outer peripherial surface of the drum 105, which is of a cylindrical form. Thus, power of the motor 117 is transmitted by way of an idle pulley 121 to the rotary drum 105 for rotating same.

The idle pulley 121 is rotatably supported on a supporting bar 123, with its tension adjusted by means of a spring 124. Mounted on another shaft 120 of the motor 117 is a Silocco fan 25 having a diameter of 160 mm.

Figure 4:
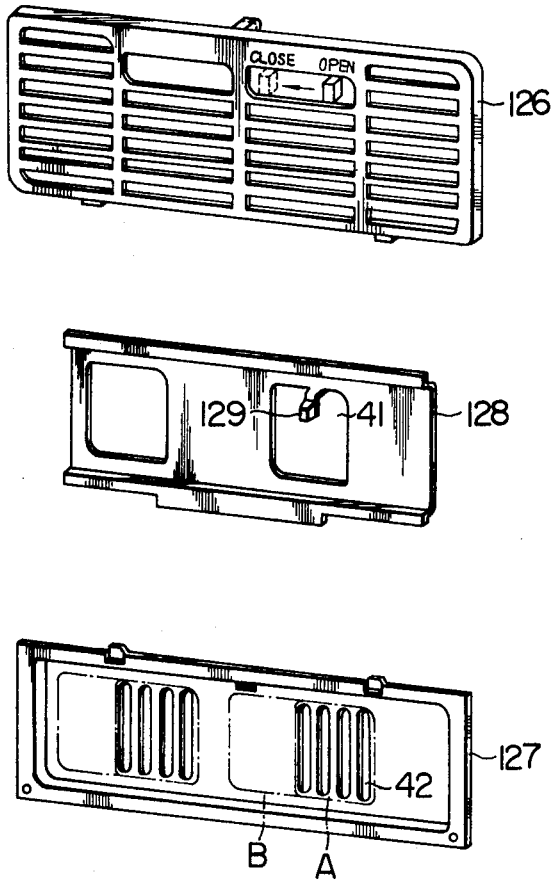
FIG. 4 is a detailed view of an air intake portion.

An air intake port 126 is provided in the lower portion of the front panel 102 of the cabinet 101. As shown in FIG. 4, the air intake port 126 is provided in the form of vertical slits provided in a member 127 and member 128.

In this respect, the maximum air flow rate may be achieved, when the slits in the member 127 are brought into register with the slits in the member 128. A knob 129 is secured to the member 127 for adjusting the position of the member 127 so as to provide a desired opening area. More particularly, when the knob 129 is shifted to its minimum opening position, then there results a condition B (in which the opening area of the members 127 and member 128 is minimized.), while the open position of the knob 129 brings about the condition A (in which the opening area of the members 127, 128 is at its maximum.) The above construction is likewise adopted to the construction of FIG. 1. PTC thermistors 130 are supported by a supporting member 131 in the upstream but on the discharge side of the fan 125. Four thermistors 130 are placed on the supporting member 131 in parallel relation to each other. The thermistors 130 have Curie temperature Tc = 175° C, so that in the event that dust clothes produced during a drying process cling to the PTC thermistors 130, there is no danger of firing of the dust clothes.

Air heated by the PTC thermistors 130 is directed through a passage 132 to perforations 107 defined in the front wall portion 108 of the rotary drum 105, the aforesaid passage 132 being defined by the front wall portion of the rotary drum 105 and members 133 and 134. The passage 132 is defined into a doughnut shape so as to encompass the perforations 107 in the rotary drum 105.

A seal member 135 is positioned in the outer peripheral portion of the passage 132 for preventing the leakage of heated air from the rotary drum 105 to the exterior. Confined between the lower projecting portion of the front wall portion 108 of the rotary drum 105 and the member 133 is a bearing portion 136 for rotatably supporting the rotary drum 105 therein.

Positioned in the rear but internally of the rotary drum 105 is a cup-shaped filter 137 adapted to collect or catch dust clothes. Provided interiorly of the filter 137 is a lint filter 138.

A bearing portion 139 is provided between the rear wall portion 110 of the rotary drum 105 and the rear panel 103 of the cabinet 101, so that the rotary drum 105 is journaled in the bearing portion 139. The bearing portion 139 is a self-aligned bearing, while the aforesaid filter 137 is fitted on the shaft securing to the rear wall 110 of the rotary drum 105 its center.

The bearing portion 139 is supported on a member 141 having a plurality of ribs 140, while the member 141 is secured to the enclosure member 104 rigidly. An exhaust port 142 is positioned above the member 141 in a manner to run through the rear panel 103 of the cabinet 101, thereby directing air from the rotary drum 105 outside the cabinet 101. A seal member 143 is positioned between the rear wall portion 110 of the rotary drum and the member 141 in a manner to encompass the perforations in the rear wall portion 110, thereby insuring discharge of exhaust air from the rotary drum 105 through the exhaust port 142 outside the cabinet 1. A control unit 144 is mounted on the inner, upper surface of the front panel 102 of the cabinet 101 for controlling the drier, while a control knob 145 is positioned on the outer surface of the front panel 102. Supporting legs 146 are secured to the bottom surface of the enclosure member 104 of the cabinet 101, thereby supporting the drier thereon.

In operation, the door 113 is opened so as to place clothes to be dried, into the rotary drum 105, after which the door 113 is closed. On the other hand, the flow rate of intake air is adjusted by using the knob 129 on the member 128. Then, the control knob 145 is set so as to start the motor 117 for rotating the rotary drum 105 as well as the fan 125 to thereby introduce air through the intake air 126 therein. The air thus introduced is pressurized by means of the fan 125 so as to be fed towards the PTC thermistors 130 for heating. In this manner, air is heated by the PTC thermistors 130 by being forcibly introduced thereto, and then air thus heated is fed through the perforations 107 provided in the front wall portion 108 of the rotary drum 105, into the drum 105, thereby heating and drying clothes therein. Then, air is discharged through the filter 157 positioned on the rear wall portion 110 of the rotary drum 105, then through the exhaust portion 142 to the exterior of the cabinet 101.

Figure 5:
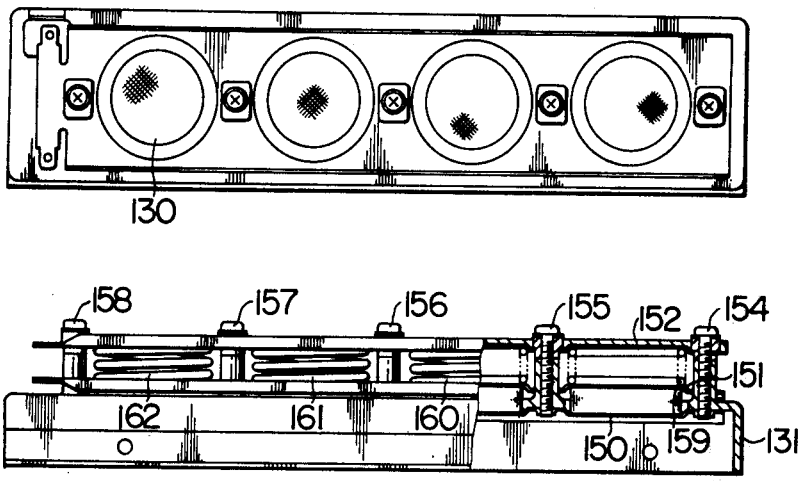
FIG. 5 is a detailed view of a heat generating portion.

FIG. 5 shows a detailed attaching portion of PTC thermistor structures. Each PTC thermistor is sandwiched between supporting plates 150, 151 which are supported by the supporting member 131 consisting of insulating materials A.C voltage is supplied between the supporting plates 150, 151. Each thermistor is urged in position by means of one of springs 159, 160, 161, 162 confined between the supporting plate 152 and another supporting plate 151. The respective supporting plates 150, 151, 152 are secured to the supporting member 131 by means of fastening means 154, 155, 156, 157, 158. The aforesaid construction of the thermistors is also adopted in FIGS. 1 and 3.

What is claimed is:

1. A clothes drier comprising:

an outer frame having a first opening formed in a front wall thereof;

a door mounted on said outer frame for sealing said first opening;

a drum rotatably supported about a substantially horizontal axis of rotation extending within said outer frame, said drum including a second opening through which clothes are charged into and taken out of said drum, an air intake portion, and an air exhaust portion;

a lint filter removably mounted inside the rear wall of said drum to collect lint given off by the clothes;

an electric blower disposed between the rear wall of said drum and said outer frame for introducing air through said air intake portion into said drum and for exhausting the air through said exhaust portion out of said drum;

air adjusting means disposed in the front wall of said outer frame for controlling the flow rate of air introduced into said drum; and heat generating means positioned between said air intake portion of said drum and said air adjusting means for heating air introduced through said air adjusting means, said heat generating means including positive temperature coefficient thermistors whereby the temperature of said heat generating means and that of the exhaust air can be adjusted without requiring thermostats for preventing overheating of said heat generating means and the clothes in said drum.

2. A clothes drier according to claim 1, wherein said air adjusting means includes an air intake port in the front wall of said outer frame, a first member providing a plurality of vertical slits relative to said air intake port, a second member providing a plurality of openings of different size than said vertical slits, and means for sliding said first and second members relative to one another such that said plurality of vertical slits and said plurality of openings are selectively brought into register.

3. A clothes drier comprising:

an outer frame having a first opening formed in a front wall thereof;

a door mounted on said outer frame for sealing said first opening;

a drum rotatably supported about a substantially horizontal axis of rotation extending within said outer frame, said drum including a second opening through which clothes are charged into and taken out of said drum, an air intake portion consisting of a large number of perforations on the front wall of said drum and surrounding said second opening, an air exhaust portion formed by a large number of perforations on the rear wall of said drum, and a cylindrical portion surrounding said second opening and rotatably supported through a bearing by means of a stationary supporting member attached to said outer frame;

a linter filter removably supported inside the rear wall of said drum to collect lint given off by the clothes, said lint filter consisting of a protective filter having a plurality of perforations and a mesh-like filter;

a fan casing having a blower therein and positioned between the rear wall of said drum and said outer frame for introducing air through said intake portion into said drum and for exhausting the air through said exhaust portion out of said drum;

an electric motor for rotating said blower and said drum;

air adjusting means disposed in the front wall of said outer frame for controlling the flow rate of air introduced into said drum;

self-aligning bearing for supporting rotatably a shaft secured at the center of the rear wall of said drum; and heat generating means provided in an air support duct connecting said air adjusting means and said air intake portion for heating air introduced through said air adjusting means, said heat generating means including positive temperature coefficient thermistors whereby the temperature of said heat generating means and that of the exhaust air can be adjusted without requiring thermostats for preventing overheating of said heat generating means and the clothes in said drum.

4. A clothes drier according to claim 3, wherein said air adjusting means includes an air intake port in the front wall of said outer frame, a first member providing a plurality of vertical slits relative to said air intake port, a second member providing a plurality of openings of different size than said vertical slits, and means for sliding said first and second members relative to one another such that said plurality of vertical slits and said plurality of openings are selectively brought into register.

5. A clothes drier according to claim 1, wherein said air adjusting means and said air intake portion are connected by an air supply duct in which said heat generating means is provided.

6. A clothes drier comprising:

an outer frame having a first opening formed in a front wall thereof;

a door mounted on said outer frame for sealing said first opening;

a drum rotatably supported about a substantially horizontal axis of rotation extending within said outer frame, said drum including a second opening through which clothes are charged into and taken out of said drum, and air intake portion, and an air exhaust portion;

a lint filter removably mounted inside the rear wall of said drum to collect lint given off by the clothes;

air adjusting means disposed in the front wall of said outer frame for controlling the flow rate of air introduced into said drum;

heat generating means positioned between said air intake portion of said drum and said air adjusting means for heating air introduced through said air adjusting means, said heat generating means including positive temperature coefficient thermistors whereby the temperature of said heat generating means and that of exhaust air from said drum can be adjusted without requiring thermostats for preventing overheating of said heat generating means and the clothes in said drum; and an electric blower disposed between said air adjusting means and said heat generating means for circulating air from said air adjusting means, past said heat generating means, and through said air intake portion into said drum, and for exhausting the air through said exhaust portion out of said drum.

7. A clothes drier according to claim 6, wherein said air adjusting means and said air intake portion are connected by an air supply duct in which said heat generating means and said electric blower are provided.

8. A clothes drier according to claim 6, wherein said air adjusting means includes an air intake port in the front wall of said outer frame, a first member providing a plurality of vertical slits relative to said air intake port, a second member providing a plurality of openings of different size than said vertical slits, and means for sliding said first and second members relative to one another such that said plurality of vertical slits and said plurality of openings are selectively brought into register.

* * * * *